US007365762B2

(12) United States Patent
Montagutelli

(10) Patent No.: US 7,365,762 B2
(45) Date of Patent: Apr. 29, 2008

(54) THERMAL PRINTING HEAD COMPRISING A PRINTABLE TAPE GUIDING MEMBER, IN THE FORM OF A PROTECTION COVER FOR A FLEXIBLE CONTROL PRINTED CIRCUIT

(75) Inventor: Denis Montagutelli, Angers (FR)

(73) Assignee: APS Engineering, Paris (FR)

( * ) Notice: Subject to any disclaimer, the term of this patent is extended or adjusted under 35 U.S.C. 154(b) by 181 days.

(21) Appl. No.: 10/508,518

(22) PCT Filed: Mar. 19, 2003

(86) PCT No.: PCT/FR03/00875

§ 371 (c)(1),
(2), (4) Date: May 25, 2005

(87) PCT Pub. No.: WO03/080348

PCT Pub. Date: Oct. 2, 2003

(65) Prior Publication Data

US 2005/0212829 A1 Sep. 29, 2005

(30) Foreign Application Priority Data

Mar. 21, 2002 (FR) ..... 02 03505

(51) Int. Cl.
*B41J 2/335* (2006.01)

(52) U.S. Cl. ..... 347/222; 347/171; 347/208; 347/209

(58) Field of Classification Search ..... 347/76, 347/200, 208

See application file for complete search history.

(56) References Cited

U.S. PATENT DOCUMENTS 3,715,564 A * 2/1973 Hiruma et al. ..... 347/201

(Continued)

FOREIGN PATENT DOCUMENTS

EP 0 729 839 9/1996

(Continued)

OTHER PUBLICATIONS

Shimada, Koji, Thermal head for example facsimile, Aug. 2003, JP 2003-220722 A, pp. 1 & 5.*

(Continued)

*Primary Examiner*—Matthew Luu
*Assistant Examiner*—John P Zimmermann
(74) *Attorney, Agent, or Firm*—Westerman, Hattori, Daniels & Adrian, LLP.

(57) ABSTRACT

A thermal printing head comprises a guide member made in a single-piece and designed as a jumper comprising two superimposed walls, covering, at least partly, respectively and jointly both surfaces of a flexible printed circuit board and providing between them a space for the passage of the support guide wing, enclosed by the flexible printed circuit board, such that the guide member can be elastically nested on the guide wing of the support and provides protection for the flexible printed circuit board in the zone of its junction with the support, and such that, one of the walls of the guide member comprising fingers producing localized elastic pressure on the flexible printed circuit board, an electric contact is provided between the flexible printed circuit board and the support for grounding the printing head via the flexible printed circuit.

16 Claims, 6 Drawing Sheets

U.S. PATENT DOCUMENTS 4,023,184 A * 5/1977 Stillman, Jr. ..... 347/208
4,347,522 A * 8/1982 Bahl et al. ..... 347/76
4,390,884 A * 6/1983 Applegate et al. ..... 346/139 C
4,555,715 A * 11/1985 Vegeais et al. ..... 347/200
4,571,598 A * 2/1986 Shinozaki et al. ..... 347/208
4,586,056 A 4/1986 Fujino et al.
4,667,210 A * 5/1987 Matsuura et al. ..... 346/139 R
4,688,050 A * 8/1987 Tsao ..... 347/171
4,806,947 A * 2/1989 Vegeais et al. ..... 347/208
4,963,886 A * 10/1990 Fukuda et al. ..... 347/209
5,063,394 A * 11/1991 Nagato ..... 347/187
5,148,188 A * 9/1992 Ota et al. ..... 347/208
5,220,353 A * 6/1993 Ota et al. ..... 347/209
5,309,181 A 5/1994 Ema et al.
5,570,123 A * 10/1996 Almonte ..... 347/200
5,689,296 A * 11/1997 Heitmann et al. ..... 347/50
5,791,793 A * 8/1998 Nagahata ..... 400/120.01
5,801,728 A * 9/1998 Yanagi et al. ..... 347/50
5,874,983 A * 2/1999 Nagahata et al. ..... 347/200
5,907,347 A * 5/1999 Nagahata et al. ..... 347/208
6,236,422 B1 * 5/2001 Nagahata et al. ..... 347/200
6,246,423 B1 * 6/2001 Suzuki et al. ..... 346/76.1
6,317,150 B1 * 11/2001 Ono et al. ..... 347/200
7,002,611 B2 * 2/2006 Mori et al. ..... 347/215
2002/0041320 A1 * 4/2002 Takizawa ..... 347/171
2006/0012635 A1 * 1/2006 Silverbrook et al. ..... 347/49

FOREIGN PATENT DOCUMENTS

EP 0 806 296 11/1997
JP 03219966 A * 9/1991
JP 04234673 A * 8/1992
JP 05008420 A * 1/1993
JP 06270446 A * 9/1994
WO WO 9813206 A * 4/1998

OTHER PUBLICATIONS

Shintani, S., Thermal head, used in thermal printer, Sep. 2005, JP 2005-238663 A, pp. 1 & 10.*
Belin et al., Thermal printing head—uses thin film resistor chip, Aug. 1984, FR 2451825 A, pp. 1 & 22.*

* cited by examiner

THERMAL PRINTING HEAD COMPRISING A PRINTABLE TAPE GUIDING MEMBER, IN THE FORM OF A PROTECTION COVER FOR A FLEXIBLE CONTROL PRINTED CIRCUIT

The invention relates to the field of thermal printing machines, notably applicable to payment terminals. Its object is a member for guiding a tape to be printed, equipping a printing head for such machines.

Thermal printing mechanisms are known, which include a support accommodating means for driving a tape to be printed against a thermal printing head, and means for controlling the dynamic members of the mechanism from remote control means. Among those mechanisms, those wherein the printing head includes a rigid support, carrying a printing member made of ceramic material and a printable tape guiding member, are known more particularly. The control means are formed, according to diverse variations, either of a rigid plate fixed to the support, said rigid plate incorporating a printed circuit, or of a flexible printed circuit within which is embedded such a circuit, the flexible printed circuit being fixed to the printing member by means of spikes or welded thereto, notably.

The difficulties to overcome in the field lie in a structural organisation of the printing head which should be simple and with small space requirements. Consequently, a preferred solution consists in using a flexible connector for the control means. However, the fragility of the flexible printed circuit, and its tricky linkage with the printing head, and notably with the printing member, tend to affect the advantages offered by their use, by reason of particular arrangements of the printing head aiming to protect the flexible printed circuit and to secure, possibly even reinforce, its link with the printing head.

Besides, a general problem to solve lies in grounding the various members participating in the printing mechanism. More particularly as regards the printing head, the former is especially fragile and might be damaged following electrostatic discharges from the surrounding elements, which said head supports and/or includes, including the tape to be printed.

It has been suggested by the document EP 0729839 (ROHM CO Ltd) to add-on by fitting on the support, a metallic guiding member for the tape to be printed, said guiding member comprising spikes extending across a rigid printed circuit forming the printing head control means, via openings that it includes. These spikes make it possible to provide an electric contact between the conducting support and the guiding member, which is also conducting, and hence between the support and the tape to be printed, with a view to evacuating the static electricity transported by said tape.

The general purpose of the present invention is to provide simple arrangements of the printing head to remedy all the aforementioned shortcomings. More precisely, it is an object of the present invention to organise the structure of the printing head so as to make the structure thereof as straightforward as possible and with the smallest space requirements possible, where such organisation makes it possible, moreover, to protect easily its sensitive members, notably the printing member and the control means, from a mechanical viewpoint as well as from the point of view of the electrostatic charges transported by the various members involved therein.

More particularly, a first specific aim of the present invention is to provide a thermal printing head arranged in order to secure the mechanic link of the various elements involved therein and in order to protect the sensitive members thereof, notably the control means and printing member, such that this arrangement is not detrimental to a simplification of its organisation nor to its small space requirements.

More particularly still, a second aim of the present invention is to provide a thermal printing head whose simple organisation and small space requirements make it possible to implement specific configurations to protect its sensitive members against the electrostatic charges present in its environment when in use.

The thermal printing head of the present invention is intended for equipping a printing mechanism of a tape to be printed, such as may be applied to payment terminals.

This printing head includes a rigid support carrying a printing member made of ceramic material, a member for guiding a tape to be printed and means for controlling the printing head. The guiding member is added to the rigid support by fitting.

According to a first approach of the present invention, the control means are composed of a flexible printed circuit fixed to the printing member. The support comprises a wing for guiding the flexible printed circuit, around which it extends partially from one large face to the other large face thereof. The guiding member, for its part, is advantageously arranged into a protection cover for the guiding wing of the support, enveloped by the flexible printed circuit. The guiding member is advantageously added to the guiding wing by fitting, notably elastic fitting, in order to cap at least partially and jointly the flexible printed circuit and the opposed large faces of the guiding wing. These configurations are such that the flexible printed circuit is oriented with a 180° return from its fastening zone to the printing member towards the outside of the printing head, while remaining protected by the guiding member.

According to an advantageous embodiment, the guiding member is formed advantageously in the general shape of a jumper, whereas its assembly by fitting on the support is performed at least by pinching the guiding wing using the guiding member between the opposite tabs of the jumper, which are preferably elastically mobile or which include, similarly, elastically antagonist members.

According to a second approach of the present invention, the control means are formed of a flexible printed circuit fixed to the printing member which is used for grounding the support by using a contact established between a bare zone of the flexible printed circuit and the support, and/or similarly between a bare zone of the flexible printed circuit and the control member, itself in electric contact with the support. This electric contact is caused by a corresponding localised pressure exerted on the flexible printed circuit by at least one finger with which the guiding member is provided.

It should be noted that the aforementioned organization of the mechanical link between the guiding member on the one hand, and the flexible printed circuit and the support on the other hand, makes it possible, advantageously, to provide a simple contact between the support and the flexible printed circuit, by using the guiding member.

According to this second approach of the present invention, the printing head is of the type wherein the guiding member is added to the support in order to provide an electric contact therebetween, for at least evacuating the electrostatic charges transported by the tape to be printed. It will be understood that the guiding member and the support are electrically conducting.

According to an aspect of the invention relating to this second approach, the control means are formed of a flexible printed circuit fixed to the printing member, and the guiding member of the printable tape is exploited for grounding the printing head via a flexible printed circuit. This guiding member comprises advantageously at least one finger, and notably a plurality thereof, for bearing locally on the flexible printed circuit. This local bearing effect establishes an electric contact between the flexible printed circuit and at least one of the support and the guiding member, for grounding the printing head via the flexible printed circuit.

It will be understood that the conducting property of any of the support and the guiding member may be limited structurally to only their zones desired to be conducting.

It will be understood that according to an advantageous embodiment combining both approaches aforementioned, the inner face of the guiding member includes said localised bearing member, arranged on the corresponding tab of the jumper.

According to a preferred embodiment of the support, said support includes a generally L-shaped profile. A first wing of the support carries, superimposed, the printing member made of ceramic material, which is notably designed as a plate. A second wing of the support, concurrent to the former, and notably substantially orthogonal, forms the guiding wing of the flexible printed circuit.

The flexible printed circuit is preferably fixed to the printing member by welding, the guiding member comprising advantageously at least one wall for covering the flexible printed circuit at least partially in its zone for covering the support. The covering wall that overlaps the flexible printed circuit in the vicinity of its welding zone is provided with at least one member for protecting the welding zones on the printing member of the flexible printed circuit, and/or, where appropriate, of their immediate vicinity.

The assembly by fitting of the guiding member on the support is preferably a fitting that is difficult to reverse, and preferably spontaneously irreversible, such as by using a clip or similar.

For example, the assembly by fitting of the guiding member on the support is comforted by a member for fitting the guiding member inside a corresponding recess of the support. It will be noted that the mechanical and electric link between the guiding member and the support is accessorily completed by means of lateral walls of the guiding member, in contact with the corresponding edges of the support.

The guiding member comprises preferably a recess facing a window of the support, for letting through an optical signal from a member detecting the tape to be printed. It will be noted that, where appropriate, this recess of the guiding member also enables the passage of a protruding optic detection member, which is advantageously supported by the flexible printed circuit.

It will be observed that according to another aspect of the invention revealing another of its advantages, the aforementioned configurations, taken individually or in combination, may be obtained by a simple arrangement of the printable tape guiding member and/or of the support, which are formed independently by a monobloc element.

According to a first embodiment of this arrangement, any of the support and/or of the guiding member is formed by cutting and folding a metal sheet.

According to a second embodiment variation of this arrangement, any of the support and/or of the guiding member is formed by moulding a conducting plastic material, the latter being either charged or provided with a conducting coating in order to be globally conducting, or incorporating conducting members embedded during the moulding operation.

The present invention will be better understood and relevant details will appear in light of the following description of a preferred embodiment, in relation with the appended drawings, wherein.

Figure 1:
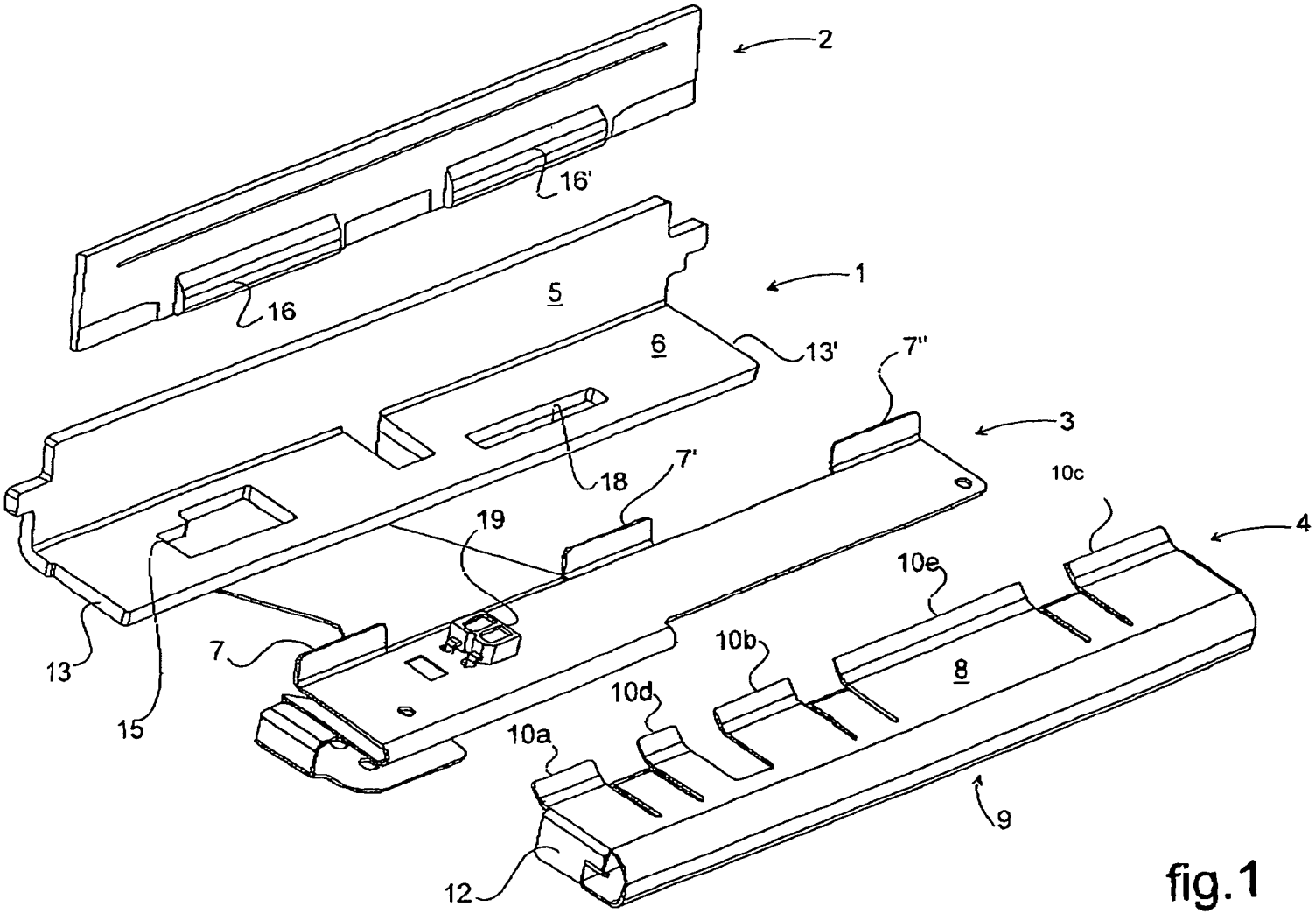
FIG. 1 is an exploded top view in perspective of a printing head according to a first embodiment of the invention.

On the Figures, a thermal printing head is mainly composed of a conducting support 1, a printing member of ceramic material 2, a flexible printed circuit 3 and a conducting guiding member 4 for a running printable tape (not represented on the Figures).

The support 1 includes two orthogonal wings 5 and 6, whereof a first wing 5 which is provided for supporting a plate 2 made of ceramic material, forming the printing member, and a second wing 6 which is provided to be enveloped by the flexible printed circuit 3, from one of its large faces to the other. The flexible printed circuit 3 comprises fastening tabs 7, 7', 7" for fixing to the printing member 2 by welding. It is visible that the 180° return of the flexible printed circuit 3 from its fastening zone makes it possible to avoid subjecting the welding zones to a detrimental tension liable to alter the fastening quality of the flexible printed circuit to the printing member.

The guiding member 4 is arranged as a cover for protecting the flexible printed circuit 3, and includes, to this end, two superimposed walls 8 and 9 to cover both faces of the flexible printed circuit 3 in contact with the second wing 6 of the support 1.

The wall 8 for covering the flexible printed circuit 3 in its fastening zone to the printing member 2 comprises members 10*a*, 10*b*, 10*c*, 10*d*, 10*e* (first variation, FIG. 1 to FIG. 3) or 20*a*, 20*b* (second variation, FIG. 4 to FIG. 6) for protecting the welding zones.

Certain zones of these protection members, possibly certain of these members properly speaking according to the first variation illustrated, are for example allocated to the protection of the welding zones of the flexible printed circuit 3 for increased tear strength; other zones of these protection members, possibly certain of these members properly speaking according to the first illustrated variation, are for example allocated to covering the vacant space between electronic members, such as 16, 16', supported by and protruding from the printing member 2, and the neighbouring edge of the corresponding wall 8 of the guiding member 4 covering the flexible printed circuit 3, in order to prevent the detrimental ingress of dirt or dust.

Besides, the guiding member 4 includes fingers 11, 11', 11" (first variation, FIG. 1 to FIG. 3) or 21, 21', 21", 21'" (second variation, FIG. 4 to FIG. 6), for localised bearing on the flexible printed circuit 3. It will be understood that this localisation of the bearing fingers 11, 11', 11" or 21, 21', 21", 21'" matches corresponding zones of the flexible printed circuit for grounding purposes. These bearing fingers make it possible to establish reliable electric contact between the support 1 and the flexible printed circuit 3.

The guiding member 4 is in electric contact with the support 1, via at least one member 17 (first and second variations, FIG. 1 to FIG. 6) and/or 22 (second variation, FIG. 4 to FIG. 6) with which it is provided, for fitting inside a corresponding housing 18 and/or 23 of the support 1. This electric contact is preferably enhanced by contacting the lateral walls 12, 12' of the guiding member 4, with the corresponding edges 13, 13' of the support 1. Consequently, the printing head is globally grounded, including the running tape in contact with the guiding member 4.

The conducting support 1 being liable to be in electric contact with the chassis of the printing mechanism (not represented on the Figures) which supports the head, the printing mechanism may therefore be grounded by the guiding member 4 of the printable tape bearing against the flexible printed circuit 3, for electric contact thereof 3 with the support 1.

It will be observed on the guiding member 4, covering the flexible printed circuit 3, the presence of a recess 14 facing a corresponding window 15 of the support 1. This recess 14 is provided for the passage of an optic member 19 supported by the flexible printed circuit 3, or at least of its signal, for detecting the presence of the printable tape.

Figure 2:
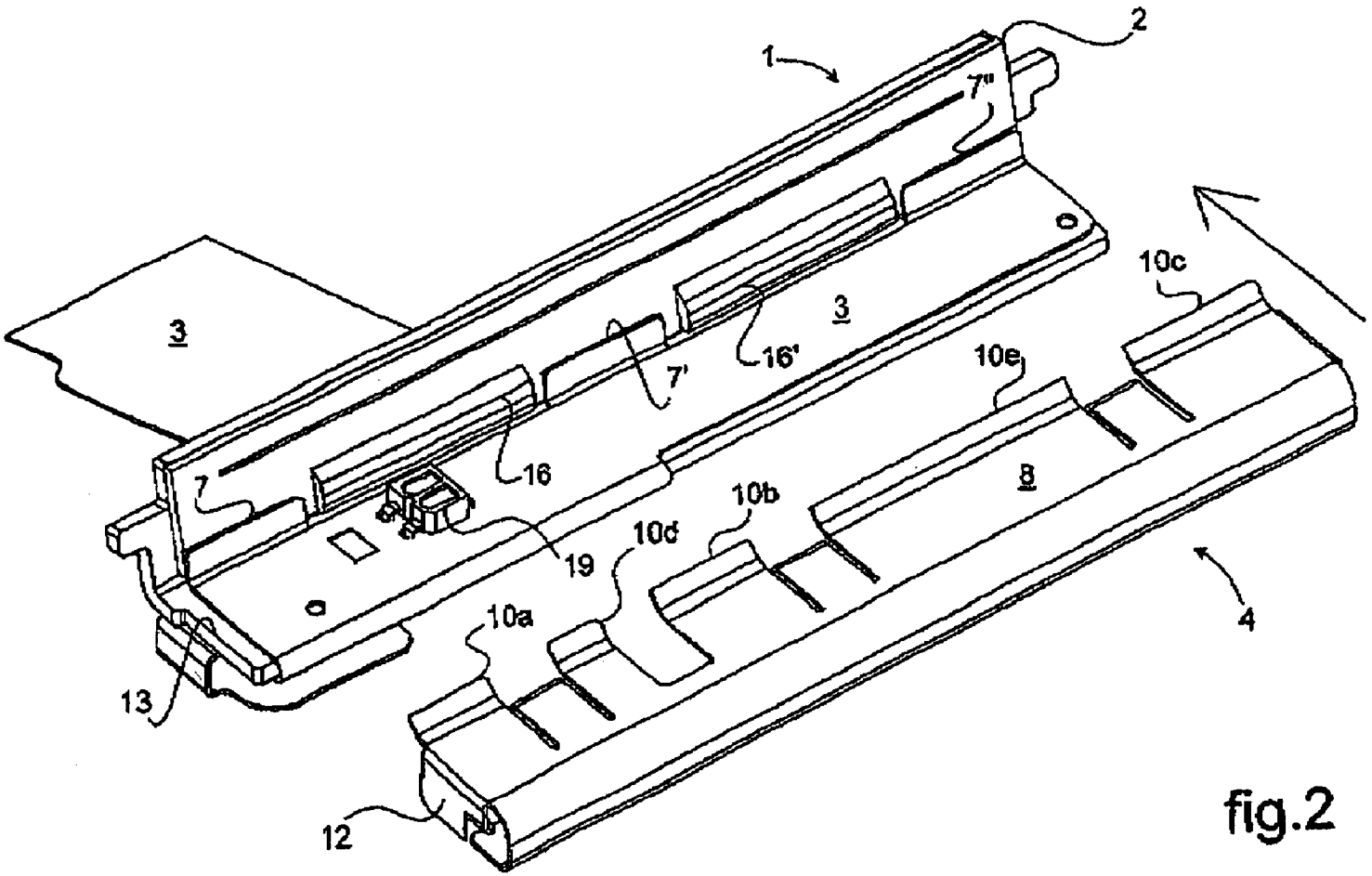
FIG. 2 is a top view in perspective of the printing head represented on FIG. 1, partially assembled.
Figure 3:
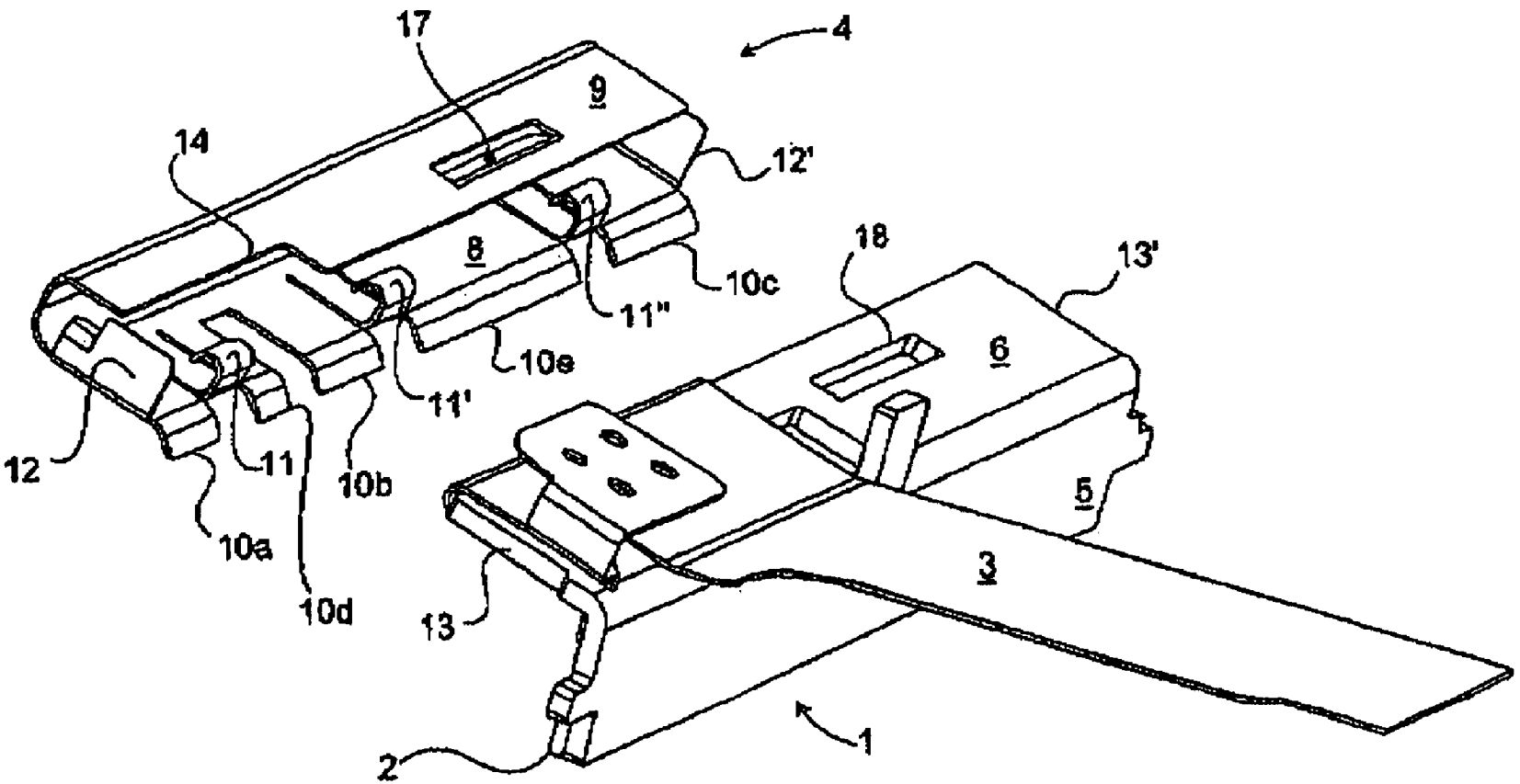
FIG. 3 is a bottom view in perspective of the printing head represented on FIG. 1 and FIG. 2, partially assembled.

According to the first embodiment variation illustrated on FIG. 1 to FIG. 3, the support 1 and the guiding member 4 are formed by cutting and folding a metal sheet.

The bearing fingers 11, 11', 11", the protection members 10*a*, 10*b*, 10*c* and 10*d*, and the fitting member 17 notably, extend from the walls 8 and 9 of the guiding member provided for covering the flexible printed circuit 3.

Figure 4:
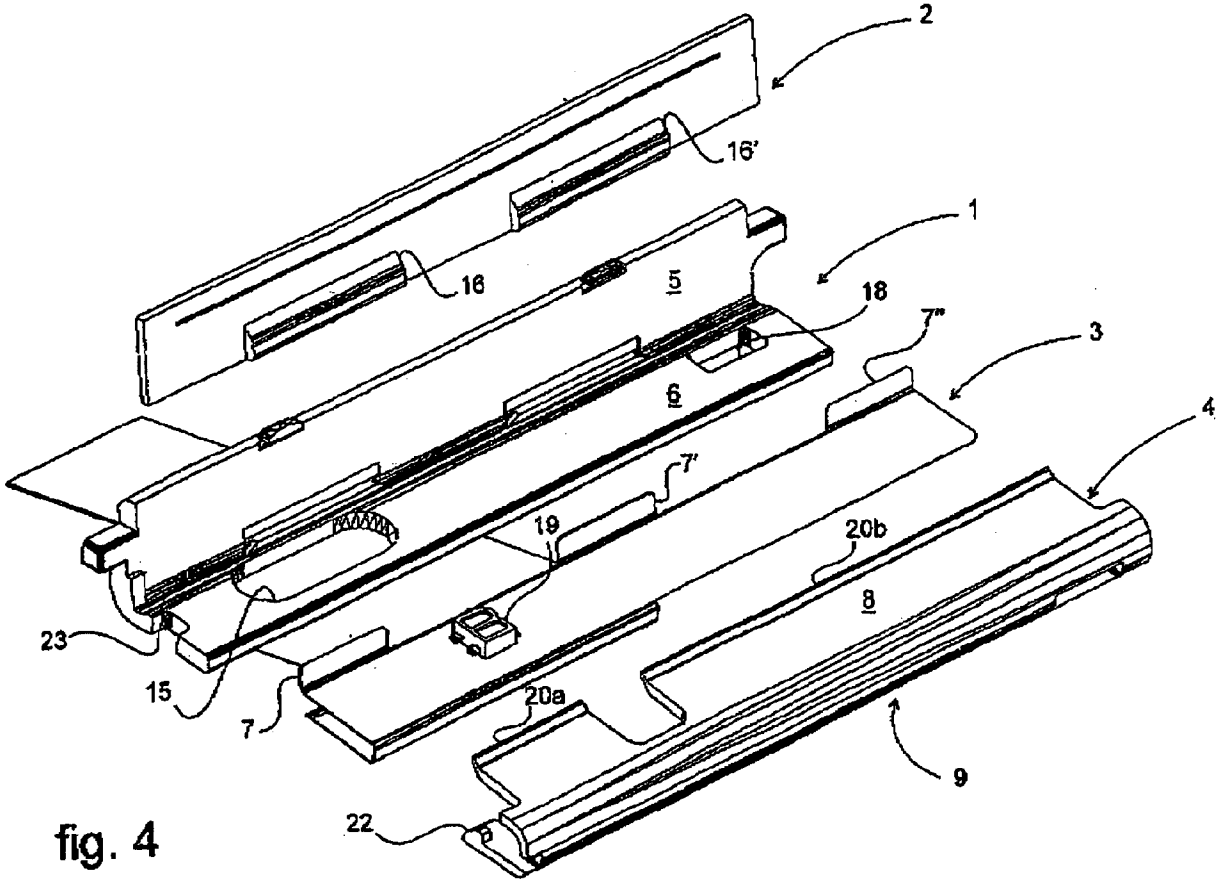
FIG. 4 is an exploded top view in perspective of a printing head according to a second preferred embodiment of the invention.
Figure 5:
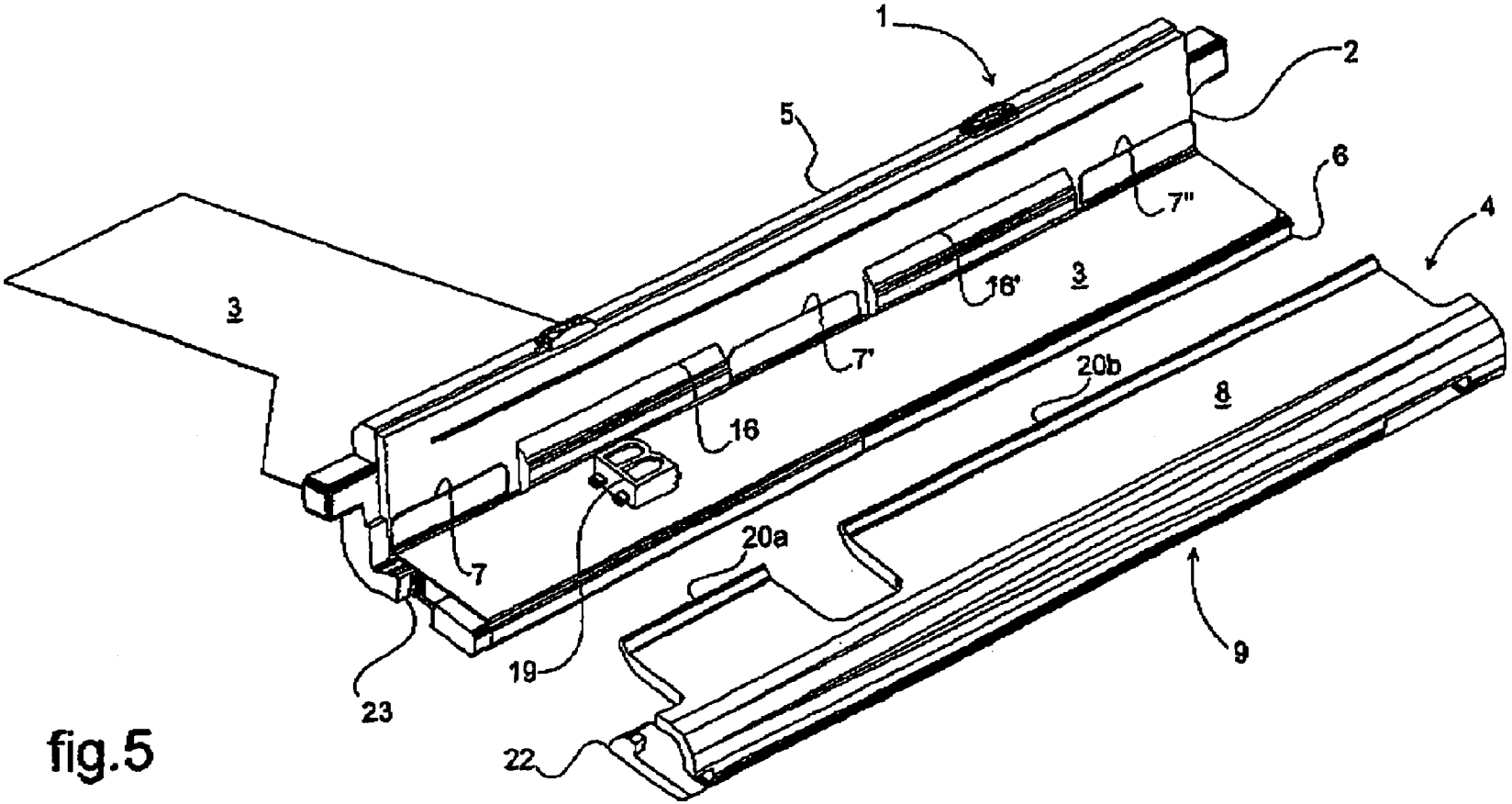
FIG. 5 is a top view in perspective of the printing head represented on FIG. 1, partially assembled.
Figure 6:
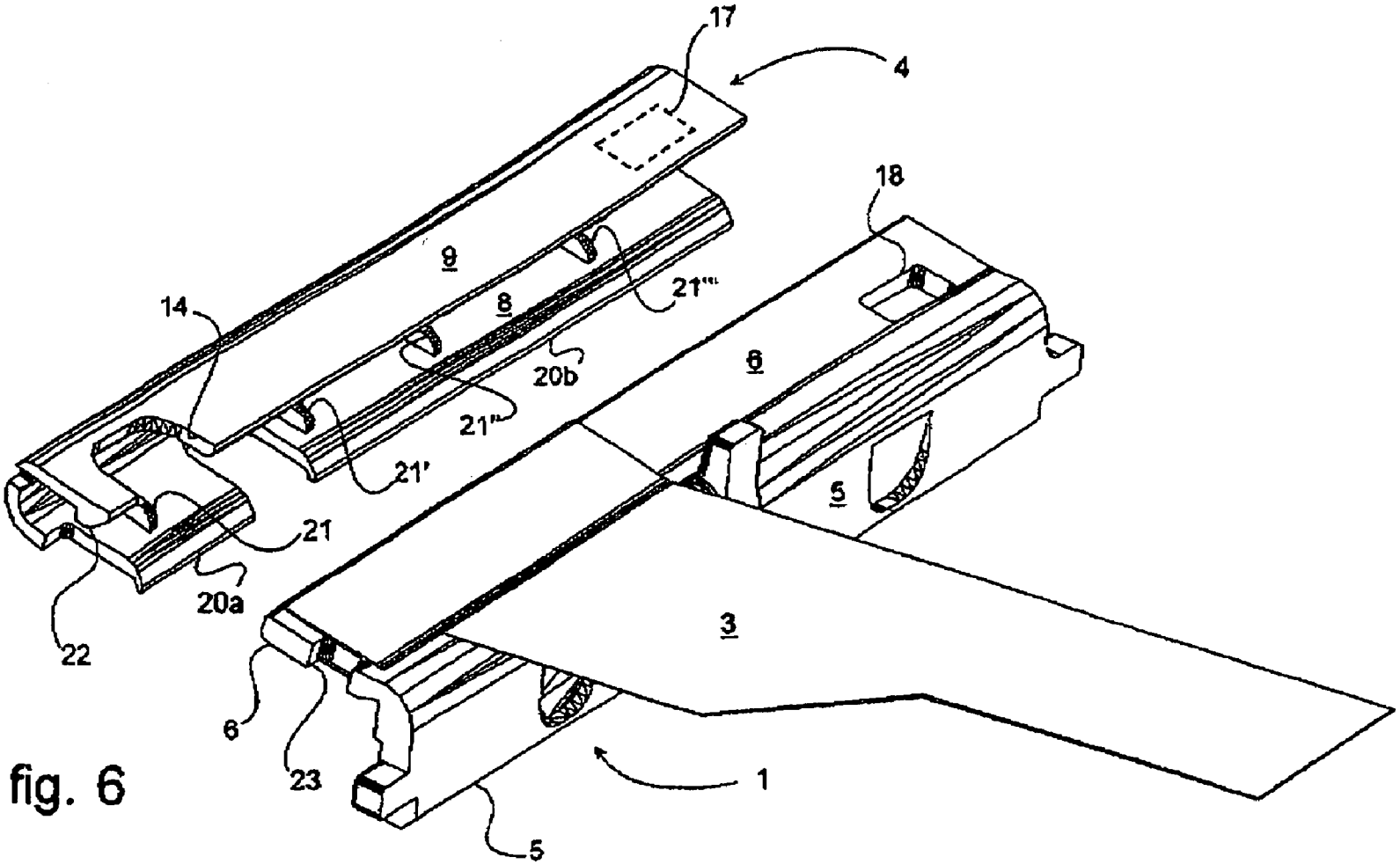
FIG. 6 is a bottom view in perspective of the printing head represented on FIG. 1 and FIG. 2, partially assembled.

According to the second embodiment variation illustrated on the FIG. 4 to FIG. 6, the support 1 and the guiding member 4 are formed by moulding a plastic material, made conducting by coating or charging, the bearing fingers 21, 21', 21", 21'", the protection members 20*a*, 20*b* and the embedding members 17 and 23 notably, being formed when moulding the guiding member 4.

There will be recognised therefore in its entirety a printable tape guiding member 4 for a thermal printing head in that it is monobloc and formed into a jumper having two superimposed walls 8 and 9 for covering, at least partially, respectively and jointly, both faces of the flexible printed circuit 3, said superimposed walls 8 and 9 providing therebetween a space for the passage of the guiding wing 6 of the support, enveloped by the flexible printed circuit 3, so that the jumper design of the guiding member 4 makes it possible to elastically fit it on the guiding wing 6 of the support 1 and makes it possible to protect the flexible printed circuit 3 in its junction zone with the support 1, including and advantageously in its welding zones to the printing member 2, and so that, one of the walls 8 of the guiding member 4 including fingers 11 or 21 for bearing locally on the flexible printed circuit 3, an electric contact is established between the flexible printed circuit 3 and the support 1, for grounding the printing head via the flexible printed circuit 3.

The guiding member 4 comprises moreover at least one fitting member 17, 12, 22 for mechanic and electric linkage with the support 1, via co-operating members 18, 13, 23 with which it is provided. The wall 8 of the guiding member 4 intended for covering the flexible printed circuit 3 in the vicinity of its fastening by welding to the printing member 2, is provided with members 10 for protecting the welding zones.

The wall 9, opposed to the previous one 8, of the guiding member 4 comprises elastic bearing fingers 11, 11', 11" or 21, 21', 21" for obtaining an electric contact between the support 1 and the flexible printed circuit 3, for grounding the printing head.

The invention claimed is:

1. A thermal printing head for printing mechanism of a printable tape, said head comprising:

(i) a rigid support, said support including a body and a guiding wing, (ii) a printing member carried by the support, (iii) a flexible printed circuit fixed to the printing member for controlling the printing head, at least a portion of said flexible printed circuit extending around the guiding wing of the support and over both large opposite faces of the guiding wing in at least a portion of the guiding wing, and (iv) a guiding member for a printable tape, wherein the guiding member is designed as a protection cover for this guiding wing enveloped by the flexible printed circuit, and the guiding member is fitted over the portion of the flexible printed circuit jointly with the portion of the guiding wing, so as to cap that portion of the flexible printed circuit jointly with the large opposite faces of the guiding wing of the support in that portion of the guiding wing, so that the flexible printed circuit is oriented with a 180° return from a fastening zone to the printing member towards the outside of the printing head, while remaining at least partially protected by the guiding member.

2. A printing head according to claim 1, wherein the guiding member is in the general shape of a jumper, its assembly by fitting on the support being performed at least by pinching the guiding wing using the guiding member between the opposite tabs of the jumper.

3. A printing head according to claim 1, wherein the guiding member is added to the rigid support by fitting so as to establish an electric contact therebetween for at least evacuating the electrostatic charges transported by the printable tape, the guiding member and the supporting board being conducting and the control means being composed of a flexible printed circuit fixed to the printing member, the printable tape guiding member comprises at least one finger for bearing locally on the flexible printed circuit, so as to establish an electric contact between the flexible printed circuit and at least one of the support and the guiding member, for grounding the printing head via the flexible printed circuit.

4. A thermal printing head according to claim 1, wherein the support has a generally L-shaped profile, whereof a first wing carries, superimposed, the printing member made of ceramic material, which is arranged as a plate, and whereof a second wing, concurrent to the former, makes up the guiding wing of the flexible printed circuit.

5. A thermal printing head according to claim 1, wherein the flexible printed circuit being fixed to the printing member by welding, the guiding member comprises at least one wall for covering the flexible printed circuit at least partially in its zone covering the supporting board, the covering wall that covers the flexible printed circuit in the vicinity of its welding zone being provided with at least one member protecting the welding zones of the flexible printed circuit on the printing member.

6. A thermal printing head according to claim 1, wherein the assembly of the guiding member by fitting on the support is comforted by a member for fitting the guiding member, said fitting member being fitted inside a corresponding recess of the support.

7. A thermal printing head according to claim 1, wherein the guiding member comprises a recess facing a window of the recess, for letting through an optical signal from a member for detecting the tape to be printed.

8. A thermal printing head according to claim 1, wherein at least one of the printable tape guiding member and the support is formed by cutting and folding a metal sheet.

9. A thermal printing head according to claim 1, wherein at least one of the printable tape guiding member and the support is formed by moulding a conducting plastic material.

10. A printable tape guiding member for thermal printing head according to claim 1, which is monobloc and formed into a jumper comprising two superimposed walls providing therebetween a space for the passage of the guiding wing of the support, enveloped by the flexible printed circuit, so that the jumper design of the guiding member makes it possible to elastically fit the guiding member on the guiding wing of the support and so that, one of the walls of the guiding member including fingers for bearing locally on the flexible printed circuit, an electric contact can be established between the flexible printed circuit and the support, for grounding the printing head via the flexible printed circuit.

11. A printing head according to claim 1, wherein the printing member is made of ceramic material.

12. A printing head according to claim 1, wherein the support comprises (i) a supporting wing carrying the printing member and (ii) the guiding wing.

13. A printing head according to claim 12, wherein the support is generally L-shaped with the supporting wing forming one branch of the L and the guiding wing forming the other branch of the L.

14. A printing head according to claim 13, wherein the wings are substantially orthogonal to each other.

15. A printing head according to claim 1, wherein the flexible printed circuit extends over substantially the totality of both large faces of the guiding wing.

16. A printing head according to claim 15, wherein the guiding member is fitted over the flexible printed circuit jointly with substantially the totality of both large faces of the guiding wings so as to cap the flexible printed circuit jointly with substantially the totality of the large opposite faces of the guiding wing.

* * * * *